US007761187B2

(12) United States Patent
Ko et al.

(10) Patent No.: US 7,761,187 B2
(45) Date of Patent: Jul. 20, 2010

(54) TUB OSCILLATION CONTROL METHOD OF DRUM TYPE WASHING MACHINE

(75) Inventors: Hong Seok Ko, Yongin-si (KR); Gyu Sung Na, Suwon-si (KR); Seung Ju Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 169 days.

(21) Appl. No.: 11/892,651

(22) Filed: Aug. 24, 2007

(65) Prior Publication Data

US 2008/0109116 A1 May 8, 2008

(30) Foreign Application Priority Data

Nov. 6, 2006 (KR) ..... 10-2006-0108954

(51) Int. Cl.
*G05B 17/02* (2006.01)
*D06F 33/02* (2006.01)

(52) U.S. Cl. ..... 700/279; 700/280; 68/12.06; 68/23.2; 8/159

(58) Field of Classification Search ..... 8/159; 68/12.06, 12.14, 12.16, 23.2, 24; 700/279, 700/280
See application file for complete search history.

(56) References Cited

U.S. PATENT DOCUMENTS 5,806,349 A * 9/1998 Kim et al. ..... 68/23.2
5,916,274 A * 6/1999 Lee et al. ..... 68/23.2
6,029,300 A * 2/2000 Kawaguchi et al. ..... 8/159
6,132,354 A * 10/2000 Ohtsu et al. ..... 494/16
6,647,575 B2 * 11/2003 Garstecki et al. ..... 8/159
7,490,490 B2 * 2/2009 Hirasawa et al. ..... 68/12.04

FOREIGN PATENT DOCUMENTS

| | | |
|---|---|---|
| EP | 0 924 330 | 6/1999 |
| JP | 2001-62189 | 3/2001 |
| KR | 1020040067089 | 7/2004 |

OTHER PUBLICATIONS

Chinese Office Action for corresponding Chinese Application 200710148923.1; issued Jun. 26, 2009.

* cited by examiner

*Primary Examiner*—Albert DeCady
*Assistant Examiner*—Douglas S Lee
(74) *Attorney, Agent, or Firm*—Staas & Halsey LLP

(57) ABSTRACT

A method controls tub oscillation in a drum type washing machine by utilizing a ball balancer. The method includes maintaining an rpm of a drum in a predetermined rpm level for a predetermine period of time during a dehydration operation, thereby reducing a differential rotation speed between the drum and a ball, and re-increasing the rpm, such that the tub is not subject to the oscillation that is greater than a predetermined level. The drum type washing machine adopts a single race having different ball sizes and viscosities, so that the manufacturing cost of the washing machine is reduced. The tub is prevented from being subject to oscillation greater than a predetermined level through precise calculation.

14 Claims, 5 Drawing Sheets

TUB OSCILLATION CONTROL METHOD OF DRUM TYPE WASHING MACHINE

CROSS-REFERENCE TO RELATED APPLICATIONS

This application claims the benefit of Korean Patent Application No. 2006-108954 filed on Nov. 6, 2006, in the Korean Intellectual Property Office, the disclosure of which is incorporated herein by reference.

BACKGROUND OF THE INVENTION

1. Field of the Invention

The present invention relates to a drum-type washing machine, more particularly to a method of reducing tub oscillation that is greater than a predetermined level caused by uneven distribution of laundry in a washing machine having a ball balancer by controlling the movement of the ball balancer in a dehydration operation.

2. Description of the Related Art

In general, a balancer provided in a drum of a washing machine has a hollow ring shape in which a solid-type movable member, such as balls, and oil are provided. When laundry placed in the drum of the washing machine is unevenly positioned and rotated in an unbalanced state, balls of the ball balancer move in a predetermined direction due to a differential centrifugal force caused by the unbalanced rotation, to compensate for the uneven distribution of the laundry unevenly placed in the drum, thereby maintaining the balanced state.

That is, the ball balancer includes a plurality of races, such as inner races and outer races which guide the movement of balls, such that the ball balancer may have different viscosities and ball sizes. In order to prevent resonant oscillation of the tub, that is, to prevent the tub from suddenly oscillating excessively at a predetermined rpm range between about 205 rpm and about 300 rpm due to the differential rotational speed between the drum and the ball before the ball reaches a balancing position, balls provided in at least two races move with a phase difference to compensate for the imbalance caused by the uneven distribution of laundry and balls.

However, the above related art adopts at least two races having different ball sizes and viscosities, so that the manufacturing cost thereof may increase. In addition, the oscillation of the tub greater than the predetermined level is prevented by reducing the occurrence probability of the oscillation greater than the predetermined level without a precise calculation, so that oscillation greater than the predetermined level cannot be perfectly prevented. Further, the related art requires more races in order to further reduce the occurrence probability of the oscillation that is greater than the predetermined level.

SUMMARY OF THE INVENTION

The present invention has been made to resolve the above-mentioned problems occurring in the prior art, and according to an aspect of the present invention, a method prevents oscillation of a tub, wherein the oscillation is greater than a predetermined level, in which an rpm of a drum is maintained at a predetermined level for a predetermined period of time before the tub is subjected to the oscillation greater than the predetermined level to reduce the differential rotational speed between the drum and a ball, and then is increased again to allow the tub to stably pass the oscillation point that is greater than the predetermined level.

To accomplish the above aspect, according to one embodiment of the present invention, a method controls tub oscillation in a washing machine, the method comprising maintaining an rpm of a drum in a predetermined rpm level for a predetermined period of time before a tub is subjected to oscillation that is greater than the predetermined level during a dehydration operation, thereby reducing a differential rotation speed between the drum and a ball, and re-increasing the rpm of the drum such that the tub is not subject to the oscillation that is greater than the predetermined level.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, the operation of an embodiment of the present invention will be explained with reference to the accompanying drawings.

Figure 1A:
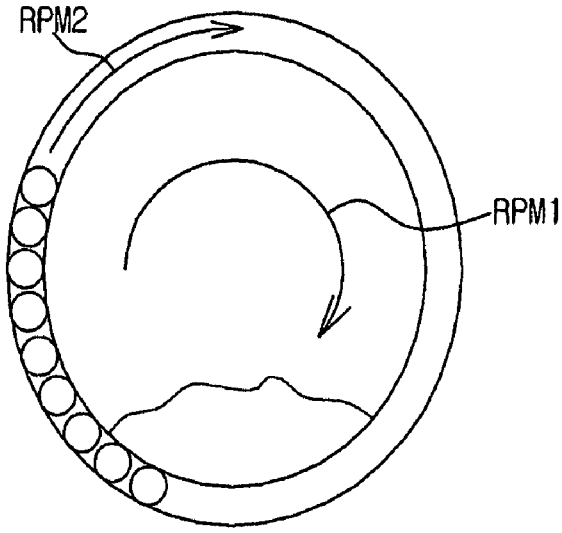
FIG. 1A is a view representing tub oscillation occurring due to a differential speed between a drum and a ball according to an embodiment of the present invention.
Figure 1B:
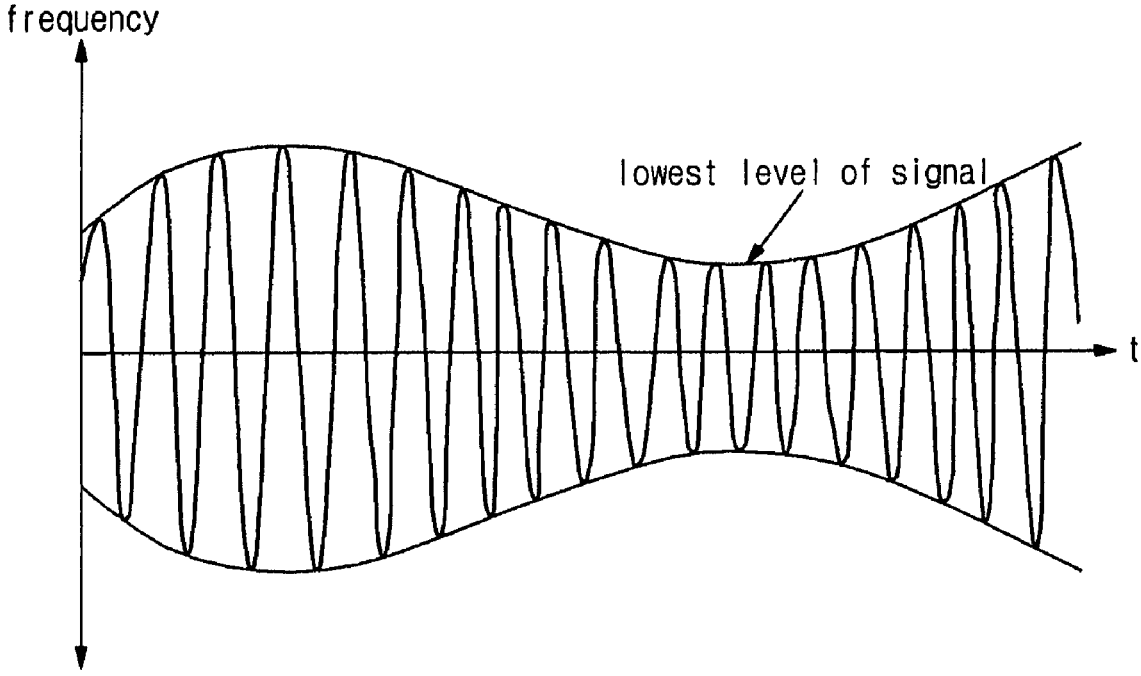
FIG. 1B is a graphical representation of frequency vs time for a tub oscillation signal of FIG. 1A.

FIG. 1A is a view representing tub oscillation occurring due to a differential speed between a drum and a ball according to an embodiment of the present invention. As shown in FIG. 1A, a rotational speed RPM1 of a drum is different from a rotational speed RPM2 of a ball, so that an oscillation frequency may occur through a modulation phenomenon. As shown in FIG. 1B, the frequency of a tub oscillation signal of the tub oscillation of FIG. 1A varies over time.

Figure 2:
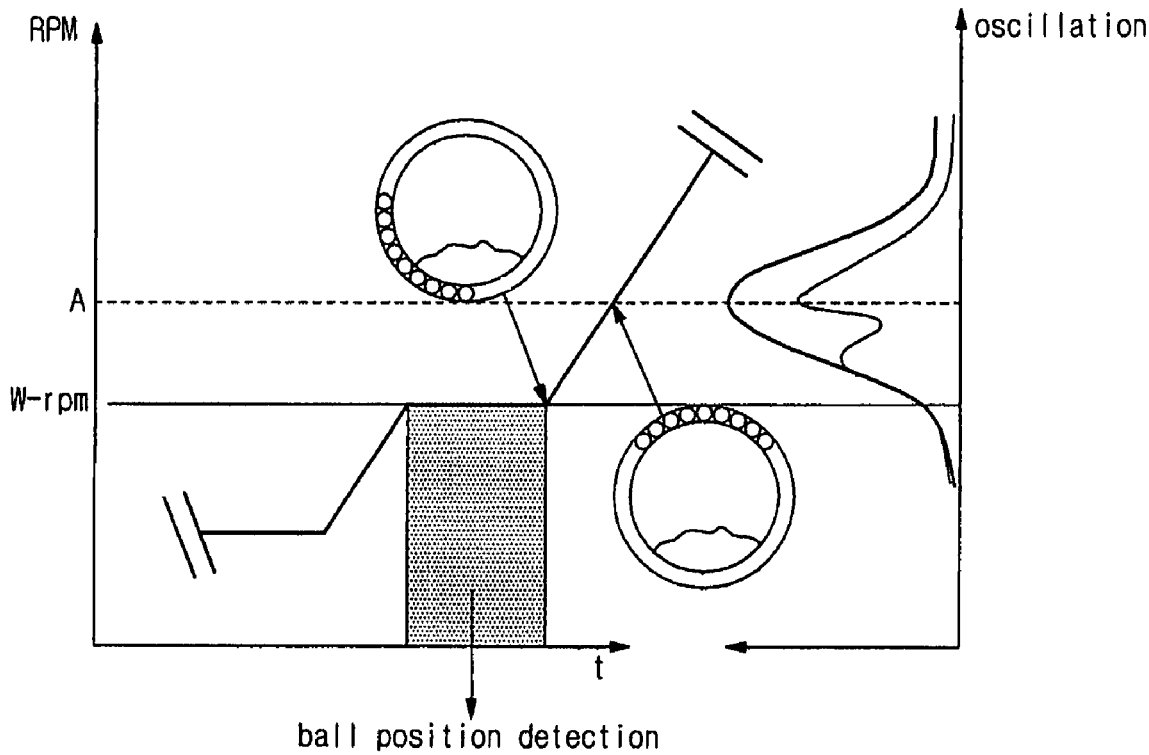
FIG. 2 is a view representing a correlation between the tub oscillation and the ball position according to an embodiment of the present invention.

For this reason, the rotational speed RPM1 of the drum is maintained at a predetermined level (sustained rpm, W-rpm) for a predetermined period of time until the oscillation frequency reaches a lowest value, and then, as shown in FIG. 2, a position of the ball is detected such that the tub is not subject to oscillation that is greater than a predetermined level. Hence, a single race having different ball sizes and viscosities may be utilized, so that the manufacturing cost of the washing machine may be reduced.

Hereinafter, the operational process for allowing the tub to pass the oscillation point that is greater than the predetermined level will be described.

Figure 3:
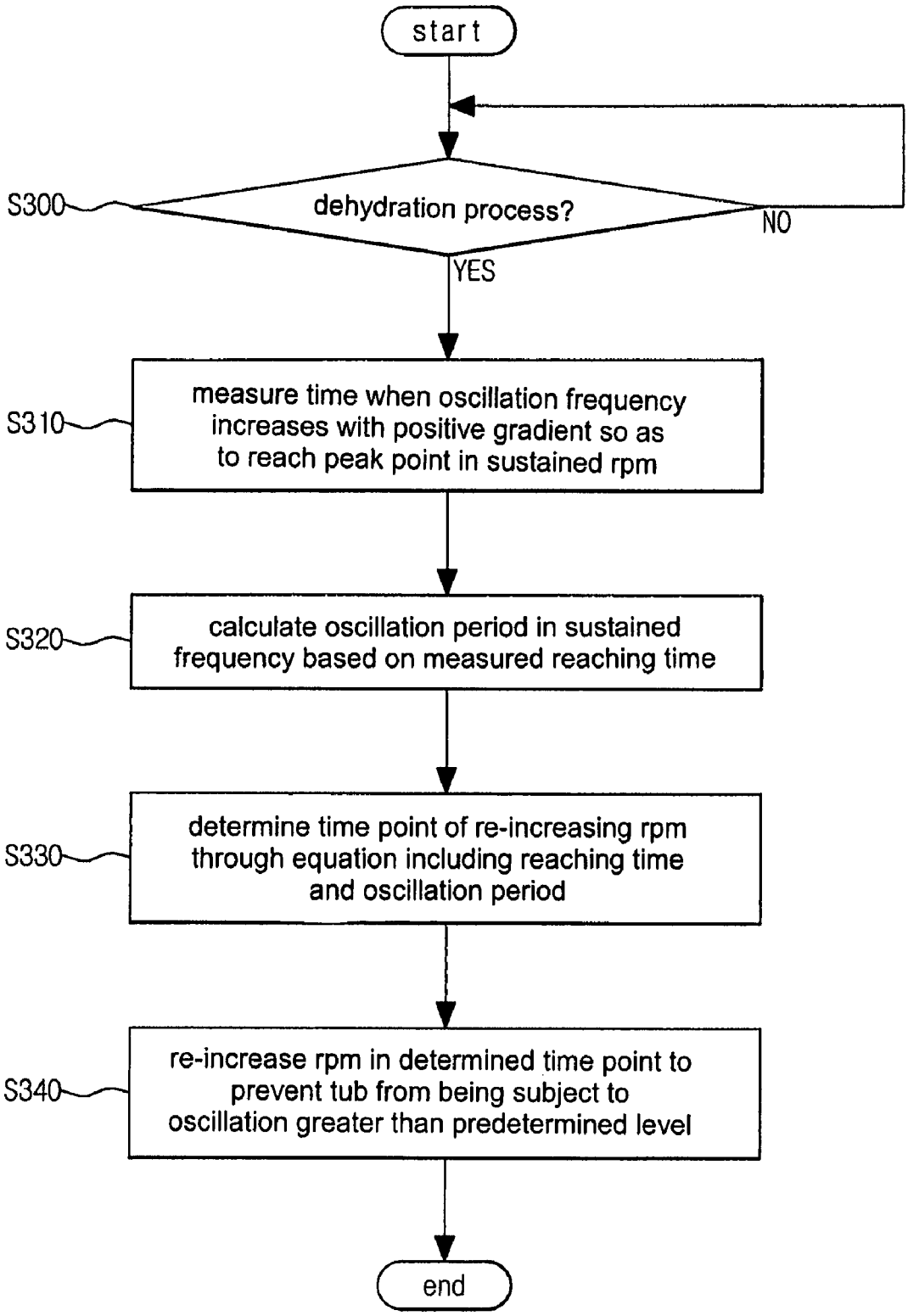
FIG. 3 is a flowchart representing a process of controlling tub oscillation in a dehydration process according to an embodiment of the present invention.

FIG. 3 is a flowchart representing a process of controlling tub oscillation in a dehydration process according to an embodiment of the present invention. As shown in FIG. 3, the rpm RPM1 of the drum is maintained at a predetermined level (sustained rpm, W-rpm) for a predetermined period of time (sustained time TS) until the oscillation frequency reaches a lowest value in the dehydration process. "A" represents an rpm level at a peak used to begin measurement of TS. At this time, a time point for re-increasing the rpm of the drum is judged based on a variation of a tub oscillation signal (S300). FIG. 3 further represents the method of the present invention, as implemented in software that may reside, completely or at least partially, within a memory and/or within a processor and/or ASICs (see below).

Figure 4:
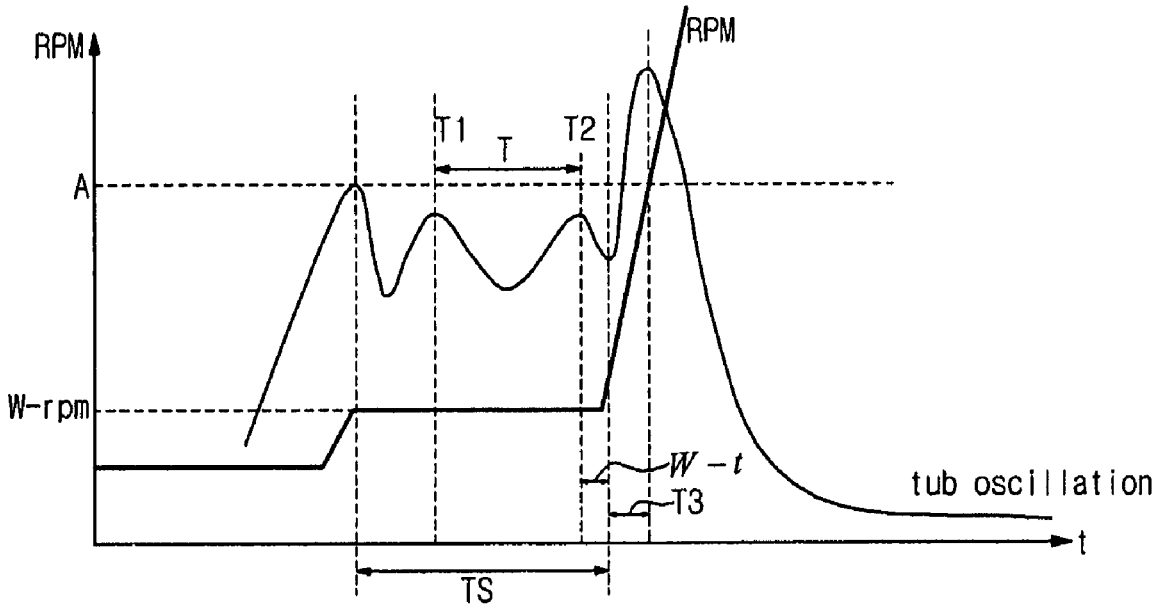
FIG. 4 is a graph representing a rotational speed variation of a drum for reducing tub oscillation according to a first embodiment of the present invention.

That is, where W represents a working example, as shown in FIG. 4, when the rpm of the drum is maintained in the sustained rpm, W-rpm, a first reaching time T1 during which the oscillation frequency starts to increase with a positive gradient so as to reach a first peak point is measured, and a second reaching time T2 during which the oscillation frequency starts to re-increase with a positive gradient so as to reach a second peak point is measured. Then, an oscillation period T in the sustained rpm, W-rpm, is calculated by using a difference between the first and second reaching times T1 and T2 (S310 and S320).

After that, a time point for re-increasing the rpm of the drum is determined through an equation obtained by using, in addition to a first reaching time T1, a second reaching time T2, and an oscillation period T, a third reaching time T3 during which the oscillation frequency starts to reach an oscillation point of the tub, wherein the oscillation point is greater than a predetermined level, in the sustained rpm, W-rpm, and the oscillation period T (S330). The equation is represented as $T2+(0.5\times T-T3)$.

Herein, $(0.5\times T-T3)$ represents a time during which the oscillation frequency starts to re-increase after reaching a predetermined peak.

After that, the rpm of the drum is re-increased at the determined time point, so that the tub passes an oscillation point that is greater than the predetermined level (S340).

In addition, different from the first embodiment in which the oscillation period is obtained in the sustained rpm A, according to a second embodiment of the present invention, the time point of re-increasing the rpm of the drum may be determined after the oscillation period T has been preset.

Figure 5:
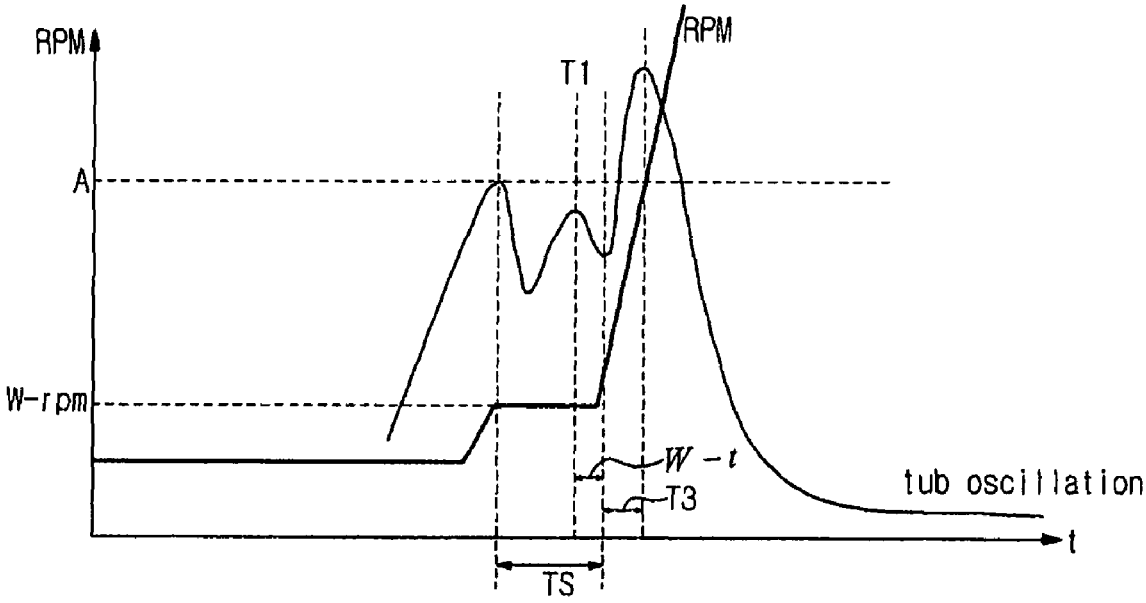
FIG. 5 is a graph representing a rotational speed variation of a drum for reducing tub oscillation according to a second embodiment of the present invention.

FIG. 5 is a graph representing a rotational speed variation of a drum for reducing the tub oscillation according to a second embodiment of the present invention. As shown in FIG. 5, when determining the time point of re-increasing the rpm of the drum, a first reaching time T1, during which the oscillation frequency starts to increase with a positive gradient so as to reach a peak point in the sustained rpm, W-rpm, is measured, and then, a time during which the oscillation frequency starts to re-increase after reaching a predetermined peak point, is measured. The time point of re-increasing the rpm of the drum may be obtained by adding the first reaching time T1 to the time W−t.

As described above, the drum type washing machine of the present invention adopts a single race having different ball sizes and viscosities, so that the manufacturing cost of the washing machine may be reduced. In addition, according to the method of controlling the drum type washing machine of the present invention, the tub is prevented from being subjected to oscillation that is greater than the predetermined level through a precise calculation, so that the oscillation of the tub, wherein the oscillation is greater than the predetermined level may be effectively prevented.

The hardware included in an embodiment of the present invention may include memories, processors, and/or Application Specific Integrated Circuits ("ASICs"). Such memory includes a machine-readable medium on which is stored a set of instructions (i.e., software) embodying any one, or all, of the methodologies described herein. Software can reside, completely or at least partially, within this memory and/or within the processor and/or ASICs. For the purposes of this specification, the term "machine-readable medium" shall be taken to include any mechanism that provides (i.e., stores and/or transmits) information in a form readable by a machine (e.g., a computer). For example, a machine-readable medium includes read only memory ("ROM"), random access memory ("RAM"), magnetic disk storage media; optical storage media, flash memory devices, electrical, optical, acoustical, or other form of propagated signals (e.g., carrier waves, infrared signals, digital signals, etc.), etc.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of controlling tub oscillation of a drum type washing machine utilizing a ball balancer, the method comprising:

maintaining an rpm of a drum in a predetermined rpm level for a predetermined period of time before a tub is subjected to oscillation that is greater than a predetermined level during a dehydration operation to reduce a differential rotation speed between the drum and a ball;

determining a time point of re-increasing the rpm of the drum based on a variation of a tub oscillation signal when the rpm is maintained in the predetermined rpm level for the predetermined period of time and re-increasing the rpm of the drum such that the tub is not subjected to the oscillation that is greater than the predetermined level, wherein the determining the re-increasing time point includes calculating an oscillation period in the predetermined rpm level using a difference between a first reaching time at which an oscillation frequency reaches a first peak point after the oscillation frequency starts to increase with a positive gradient after the rpm of the drum has reached the predetermined rpm level, and a second reaching time at which the oscillation frequency reaches a second peak point after the oscillation frequency starts to re-increase with a positive gradient.

2. The method as set forth in claim 1, wherein determining the re-increasing time point further comprises considering a difference between the first and second reaching times, which are obtained in the predetermined rpm level, and a third reaching time from a point at which the oscillation frequency starts to re-increase again with a positive gradient to when the oscillation frequency reaches an oscillation point that is greater than a predetermined oscillation level of the tub.

3. The method as set forth in claim 2, wherein the equation is represented as $T2+(0.5\times T-T3)$, where T2 is the second reaching time, T is the oscillation period and T3 is the third reaching time.

4. The method as set forth in claim 1, wherein, when the rpm is maintained in the predetermined rpm level for the predetermined period of time, the time point of re-increasing the rpm of the drum is determined by adding a reaching time at which an oscillation frequency reaches a peak point after the oscillation frequency starts to increase with a positive gradient after the rpm of the drum has reached the predetermined rpm level, to a time period between when the oscillation frequency reaches the peak point and a point immediately before the oscillation frequency starts to re-increase.

5. The method of claim 1, wherein the ball balancer includes a single race.

6. The method of claim 1, wherein the ball balancer includes different ball sizes.

7. The method of claim 1, wherein the ball balancer includes balls having different sizes and a race having different viscosities.

8. A machine-readable medium on which a program is stored for implementing a method of controlling tub oscillation of a drum type washing machine utilizing a ball balancer, wherein the method comprises:

maintaining an rpm of a drum in a predetermined rpm level for a predetermined period of time before a tub is subjected to oscillation that is greater than a predetermined level during a dehydration operation to reduce a differential rotation speed between the drum and a ball;

determining a time, point of re-increasing the rpm of the drum based on a variation of a tub oscillation signal when the rpm is maintained in the predetermined rpm level for the predetermined period of time and re-increasing the rpm of the drum such that the tub is not subjected to the oscillation that is greater than the predetermined level, wherein, when the rpm is maintained in the predetermined rpm level for the predetermined period of time, a time point of re-increasing the rpm of the drum is determined by adding a reaching time at which an oscillation frequency reaches a peak point after the oscillation frequency starts to increase with a positive gradient after the rpm of the drum has reached the predetermined rpm level, to a time period between when the oscillation frequency reaches the peak point and a point immediately before the oscillation frequency starts to re-increase.

9. The machine-readable medium as set forth in claim 8, wherein the determining the re-increasing time point includes calculating an oscillation period in the predetermined rpm level using a difference between a first reaching time at which an oscillation frequency reaches a first peak point after the oscillation frequency starts to increase with a positive gradient after the rpm of the drum has reached the predetermined rpm level, and a second reaching time at which the oscillation frequency reaches a second peak point after the oscillation frequency starts to re-increase with a positive gradient.

10. The machine-readable medium as set forth in claim 8, wherein the re-increasing time point is determined by utilizing an equation using a first reaching time at which an oscillation frequency reaches a first peak point after the oscillation frequency starts to increase with a positive gradient after the rpm of the drum has reached the predetermined rpm level, a second reaching time at which the oscillation frequency reaches a second peak point after the oscillation frequency starts to re-increase with a positive gradient, an oscillation period calculated by using a difference between the first and second reaching times, which are obtained in the predetermined rpm level, and a third reaching time from a point at which the oscillation frequency starts to re-increase again with a positive gradient to when the oscillation frequency reaches an oscillation point that is greater than a predetermined oscillation level of the tub.

11. The machine-readable medium as set forth in claim 10, wherein the equation is represented as $T2+(0.5\times T-T3)$, where T2 is the second reaching time, T is the oscillation period and T3 is the third reaching time.

12. The machine-readable medium of claim 8, wherein the ball balancer includes a single race.

13. The machine-readable medium of claim 8, wherein the ball balancer includes different ball sizes.

14. The machine-readable medium of claim 8, wherein the ball balancer includes balls having different sizes and a race having different viscosities.

* * * * *

UNITED STATES PATENT AND TRADEMARK OFFICE

CERTIFICATE OF CORRECTION

PATENT NO. : 7,761,187 B2
APPLICATION NO. : 11/892651
DATED : July 20, 2010
INVENTOR(S) : Hong Seok Ko et al.

It is certified that error appears in the above-identified patent and that said Letters Patent is hereby corrected as shown below:

Column 5, Line 19, delete “time,” and insert --time--, therefor.

Signed and Sealed this
Fourth Day of January, 2011

David J. Kappos

David J. Kappos
*Director of the United States Patent and Trademark Office*